United States Patent [19]

Neville

[11] Patent Number: 4,945,930

[45] Date of Patent: Aug. 7, 1990

[54] APPARATUS FOR EXPANDING AND/OR DRYING PARTICULATE MATERIAL

[75] Inventor: Richard E. G. Neville, Dauntsey, Great Britain

[73] Assignee: GBE International PLC, Great Britain, Great Britain

[21] Appl. No.: 326,667

[22] PCT Filed: Jul. 1, 1988

[86] PCT No.: PCT/GB88/00512

§ 371 Date: Mar. 1, 1989

§ 102(e) Date: Mar. 1, 1989

[87] PCT Pub. No.: WO89/00014

PCT Pub. Date: Jan. 12, 1989

[30] Foreign Application Priority Data

Jul. 2, 1987 [GB] United Kingdom ..... 8715523
Feb. 5, 1988 [GB] United Kingdom ..... 8802654

[51] Int. Cl.[5] ..... A24B 3/18

[52] U.S. Cl. ..... 131/296; 131/302; 131/303; 131/304; 131/306

[58] Field of Search ..... 131/296, 302, 303, 304, 131/305, 306

[56] References Cited

U.S. PATENT DOCUMENTS 4,235,249 11/1980 Psaras ..... 131/296
4,554,932 11/1985 Conrad et al. ..... 131/296

*Primary Examiner*—V. Millin
*Attorney, Agent, or Firm*—James Creighton Wray

[57] ABSTRACT

Apparatus for the expansion of tobacco includes a substantially cylindrical container (10), conveyors for feeding tobacco into the container and jet nozzles or slits for introducing a heating medium in the form of steam and/or humid air into the container. The jet nozzles or slits (12) are arranged substantially longitudinally of the container axis serving to direct high pressure steam and/or humid air substantially tangentially to the interior surface of the container (10) to engage the tobacco being fed into the container causing a turbulent mixture of steam, and/or humid air, and tobacco to travel along a helical path and to be maintained by centrifugal force in close proximity to the interior surface of the container as the stream moves axially therein and to maintain the circulation and to provide a succession of repeated high relative velocity, highly turbulent and dispersive contacts between the heating medium and the tobacco. Separating devices (27, 29, 30) are included for separating the steam and/or humid air from the treated tobacco. Also, a system (14, 15, 16, 17, 19, 26) is provided for recycling the steam and/or humid air to the jet nozzles or slits (12).

By superheating steam circulating through the apparatus the tobacco may be expanded and dried in one operation.

14 Claims, 6 Drawing Sheets

APPARATUS FOR EXPANDING AND/OR DRYING PARTICULATE MATERIAL

BACKGROUND TO THE INVENTION

This invention concerns apparatus for the continuous expansion or puffing and drying of tobacco products by rapid heating; in particular the cut mid rib of tobacco leaves.

The object of the expansion is to restore to tobacco the cell or capillary size of the living leaf, which is lost during curing, thereby increasing its bulk specific volume and increasing the firmness of manufactured cigarettes.

Many known methods have been developed for bringing about this expansion, but each has its own particular disadvantages. For example four principal methods are:

1. Wetting of the tobacco followed by microwave heating is expensive in power and can rupture the tobacco.
2. Wetting of the tobacco followed by freeze drying is a batch process and very expensive in power.
3. Impregnation of the tobacco by liquid Freon followed by rapid heating is an expensive process and involves an undesirable additive.
4. Impregnation of the tobacco by liquid carbon dioxide under pressure followed by decompression and rapid heating is a batch process involving very high pressure (30 bar) equipment.

It is also well known to dry cut tobacco under humid conditions. This gives moderate expansions on-line without additional equipment. The expansion can be further enhanced by pre-treating the cut tobacco with additional water before drying. This is known as double wetting and requires dryers of greater moisture removal capacity.

Preheating the tobacco with steam to near 100 degrees C, with and without the addition of water, also enhances the expansion, and avoids the necessity for operating the dryer under humid conditions. The additional equipment for wetting and steaming can be a simple cylinder or vibrating conveyor. However the expansion obtained of up to 40% with cut stem is not as great as attained with the four methods referred to above.

In recent years it has been found that rapid heating with a gas of high humidity, normally high humidity air or saturated or superheated steam is the principle factor in further increasing expansion by this method. The objective is to heat the moisture in the tobacco cells so rapidly that the vapour pressure is increased and the cells expanded before the vapour can escape.

There are several conditions which contribute to achieving maximum expansion by rapid heating:

1. High temperature difference between the tobacco and heating medium.
2. High relative velocity between the tobacco and heating medium.
3. Turbulent gas flow.
4. Dispersion of the tobacco.
5. High humidity gas.

The first four conditions increase the heat transfer and the fifth suppresses the evaporation of the water vapour from within the tobacco to enable it to approach boiling point.

It is advantageous to achieve a high relative velocity, dispersion and turbulent flow to maximise the expansion rather than very high temperature differences. Dispersion is very important as it ensures that 100% of the tobacco receives the expansion treatment. As a consequence of rapid heating process times are very short, in the order of 0.1 to 10 secs, i.e., around 1 sec.

STATEMENT OF PRIOR ART

There are a number of known methods by which rapid heating is achieved, e.g. as disclosed in the following patents:

| | | | |
|---|---|---|---|
| Philip Morris | US 3,734,104 | 1971 | Buchanan et al |
| American Brands | US 4,040,431 | 1975 | Ashworth et al |
| American Brands | US 4,044,780 | 1975 | Kelly |
| American Brands | UK 2,111,820 | 1981 | Hibbits |
| Brown & Williamson | UK 2,149,897 | 1983 | Denier |

This first group involves feeding tobacco into a duct and transporting it with high temperature high humidity air or superheated steam. They all dry the tobacco as well as expanding it. As a result the air or steam must be at high temperatures to provide the latent heat of evaporation.

In a second group the expansion process is separate from the drying process, which is conventional and so a higher humidity heating medium can be used; eg:

| | | | |
|---|---|---|---|
| Korean Monopoly | US 4,418,706 | 1981 | Kim |
| Hauni | UK 2,138,666 | 1983 | Hackmack |
| Rothchild | WO 85/00 273 | 1983 | Rothchild |

In the first group the process was preceded by double wetting to provide an additional source of vapour. In the second group the expansion is achieved with tobacco at normal cutting moistures, which in the case of cut stem is typically 30 to 36%.

Moisture and heat are necessary to render the material of the cell and capillary walls elastic to permit expansion to take place. Conversely the tobacco must be dried and cooled to harden the tobacco structure and fix the expansion.

In general drying and expansion have contradictory humidity requirements. Drying requires a low humidity heating medium to remove moisture from the tobacco and expansion requires a high humidity heating medium to suppress the evaporation of moisture from the tobacco.

It is therefore desirable to provide an apparatus which both contains and transports the tobacco while subjecting it to the conditions listed above, and in particular the high relative velocity, dispersion and turbulence.

The Korean Monopoly in their U.S. Pat. No. 4,418,706 aim at solving this problem by feeding tobacco via a venturi section into a transporting duct containing high velocity and slightly superheated steam. The relative velocity at the intake is very high but reduces to the normal transport difference of about 2 to 3 m/s as the tobacco accelerates. The process time is 33 ms. The tobacco is only treated once with the high velocity steam and is unlikely to be fully dispersed.

Hauni in their UK Patent No. 2,138,666 aim to solve this with a vibrating conveyor having a heated trough. The trough is perforated to provide an updraught of superheated steam and fitted with a lid to form a tunnel. Steam at a temperature of 183 degrees C is used at such a velocity that with the aid of the vibration it pseudo fluidises the tobacco. The time through the tunnel is 8 secs.

The weakness of the Hauni method is that the mean velocity of the steam is limited by the fluidising velocity to around 1 m/s. The velocity at a perforation is considerably higher, but there are relatively few perforations of small diameter at wide spacing and only a small proportion of the tobacco will be subject to this higher velocity.

Rothchild in his PCT 85/00273 describes a down draught porous conveyor reduced to the form of a 0.5 mm mesh drum with a tobacco layer on the outside and a radial inward flow of heated gas preferably steam. Gas temperatures up to 370 degrees C are used with gas velocities of 3 m/s and gas velocities up to 9 m/s with gas temperatures of 140 degrees C. Process times are 3 to 4 secs.

The difficulties of this system are the forming of a thin uniform layer of tobacco (about 6 mm) which avoids blinding the screen.

Filling value improvements over 50% are claimed with these methods.

OBJECT OF THE INVENTION

An object of this present invention is to provide an apparatus to transport and contain a tobacco product while subjecting it to rapid heating from humid air and/or steam, in which the relative velocity between the tobacco and air or steam is maintained at a higher value than in prior art apparatus and in which turbulent conditions are maintained to improve the heat transfer and disperse the tobacco.

SUMMARY OF THE INVENTION

According to the invention there is provided a method for the expansion of tobacco in which the tobacco to be treated is fed into a substantially cylindrical container and steam and/or humid air introduced into the container, characterized in that the tobacco is continuously fed into the container at or near one end and out at the other end, and the steam is introduced substantially tangentially to the interior surface of the container by way of jet nozzles or slits to engage the entering tobacco causing the resulting turbulent mixture of steam and tobacco to travel along a helical path and to be maintained by centrifugal force against the interior surface of the container as the stream moves axially therein, and to maintain the circulation and to provide a succession of repeated high relative velocity, highly turbulent and dispersive contacts between the heating medium and the tobacco, separating the steam and/or humid air from the treated tobacco which is maintained by centrifugal force in close proximity to the interior surface of the cylinder, said steam and/or humid air being recycled to the jet nozzles or slits.

Preferably the tobacco is steam heated rapidly to 100 degrees C or a few degrees above 100 degrees C to cause expansion of the tobacco and is then dried to fix the tobacco in the expanded state.

Further according to the invention, there is provided an apparatus for carrying out the method including a substantially cylindrical container, means for feeding tobacco into the container and means for introducing a heating medium such as steam and/or humid air into the container, characterized in that said means for introducing the steam and/or humid air comprise jet nozzles or slits arranged substantially longitudinally of the container axis serving to direct high pressure steam and/or humid air substantially tangentially to the interior surface of the container to engage the tobacco being fed into the container causing a turbulent mixture of steam, and/or humid air, and tobacco to travel along a helical path and to be maintained by centrifugal force in close proximity to the interior surface of the container as the stream moves axially therein and to maintain the circulation and to provide a succession of repeated high relative velocity, highly turbulent and dispersive contacts between the heating medium and the tobacco, and in that there are included means for separating the steam and/or humid air from the treated tobacco and means for recycling the steam and/or humid air to the jet nozzles or slits.

Preferably the apparatus includes a tubular separating part centrally disposed within said cylinder, through which said steam and/or humid air leaves the container.

According to another feature of the present invention the tobacco is treated with superheated steam at a temperature high enough to effect both expansion and drying in the same treatment. For this purpose a preferred temperature is 150° C. to 500° C. for example 300 C. This can be accomplished by the heating apparatus of the present invention provided that a sufficiently large superheater is employed to achieve the superheat temperature and to supply the amount of heat required to evaporate the moisture and dry the tobacco.

In this way a separate drier is rendered unnecessary but may be used if desired.

The invention will now be described by way of example with reference to the accompanying drawing in which:

DESCRIPTION OF PREFERRED EMBODIMENT

Figure 6:
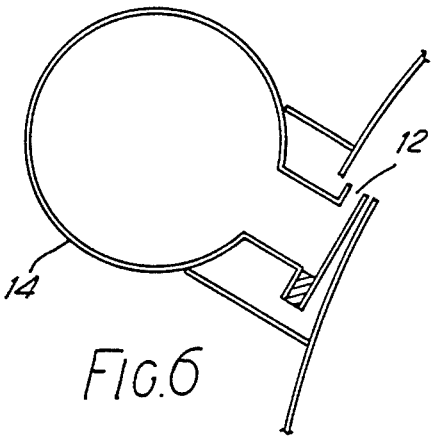
FIG. 6 is a part section of a jet inlet taken along the line A—A on an enlarged scale.
Figure 5:
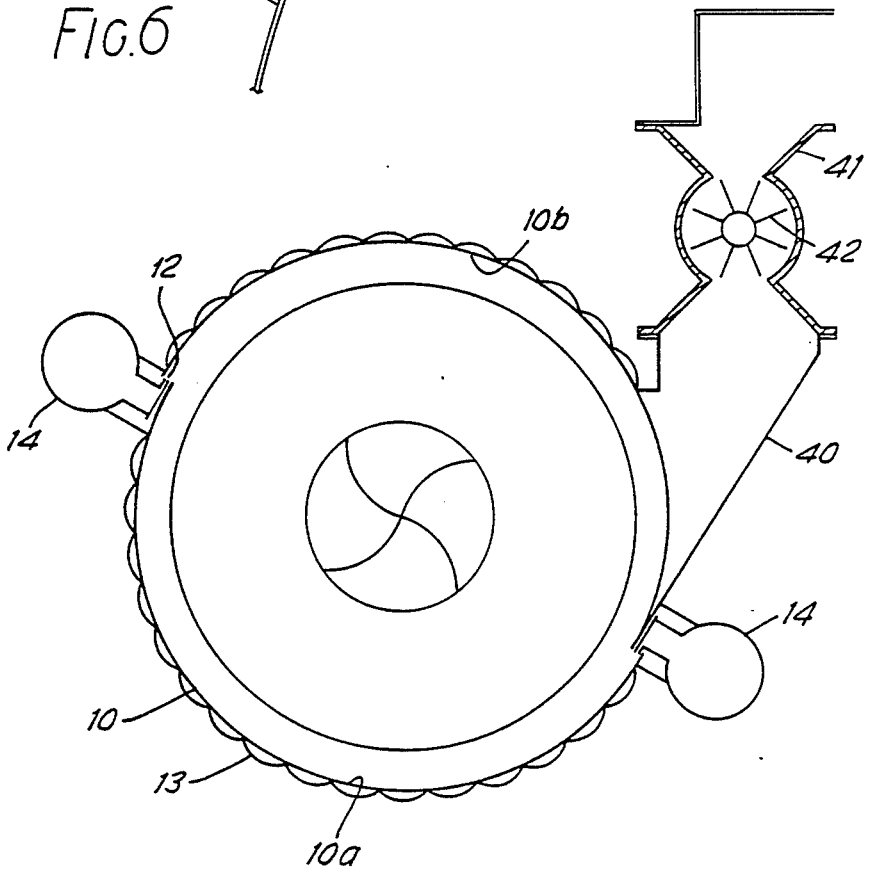
FIG. 5 is a cross section taken along the line A—A in FIG. 1.
Figure 5:
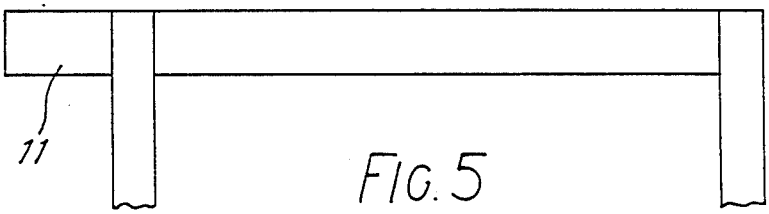
Figure 7:
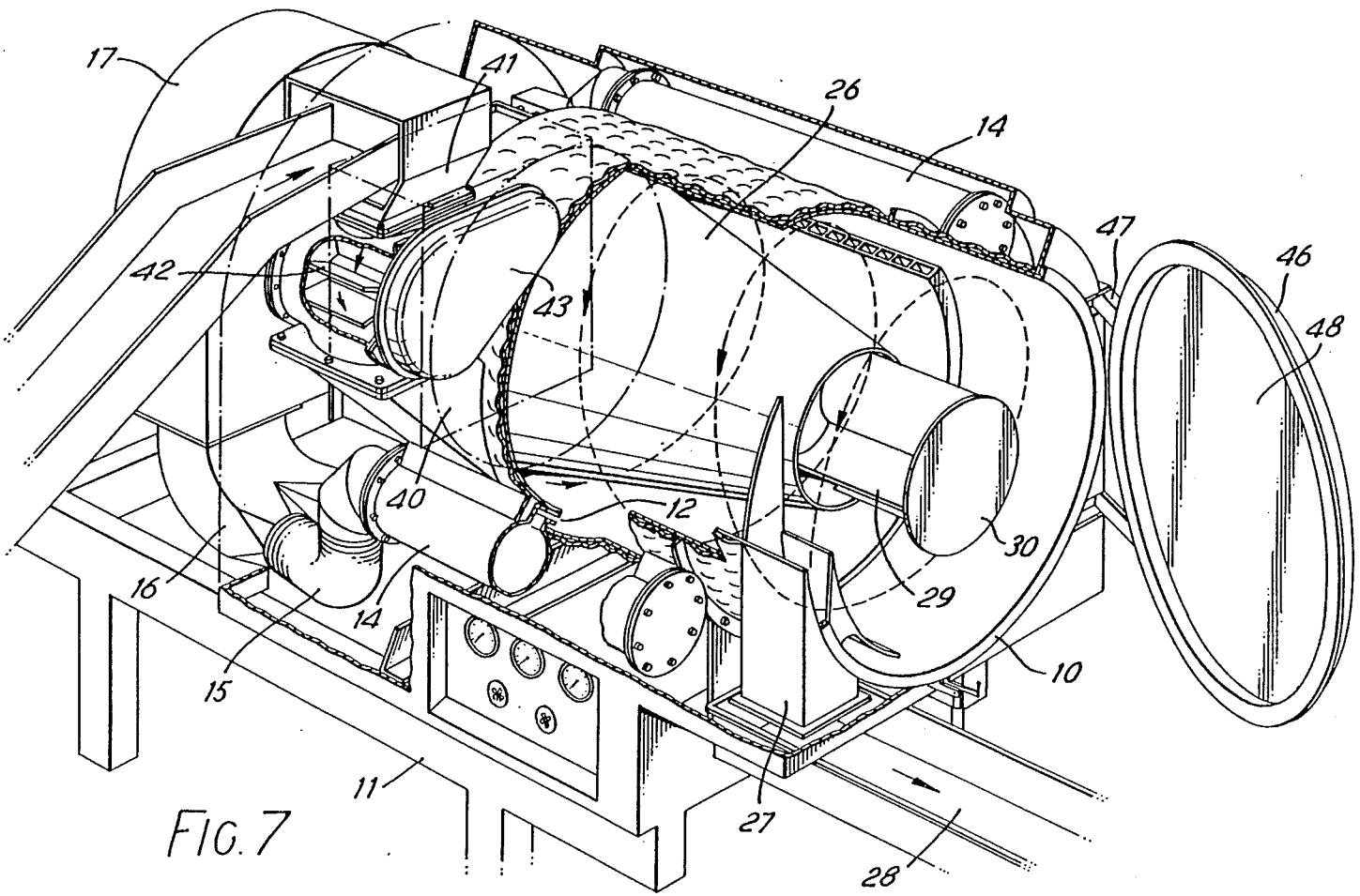
FIG. 7 is a perspective view of the machine with part of the cylinder shown cut away for clarity.

The apparatus comprises a heated and insulated cylinder 10 non-rotably mounted on a frame 11, with one or more and preferably two series of jet nozzles 12 (see FIG. 6) extending for nearly the full length of the cylinder, which are parallel to the axis and directed into the interior of the cylinder at a substantially tangential angle. As seen from the section A—A in FIG. 5, the cylinder is formed by two halves of a cylinder divided longitudinally and arranged with their axes slightly offset from each other. The jet nozzles are arranged at the longitudinal junctions of the two half cylinders. The cylinder is heated on the outside by an arrangement of limpet tubes 13, fed with low pressure steam at one end and drained by a steam trap at the other.

The jets 12 are fed with steam circulating through the system via nozzle chambers 14 and pipes 15 connected to a manifold 16 which in turn is connected to the outlet of a fan 17. The steam leaving the cylinder axially (to be described hereinafter) is passed through a duct 19 which is connected to the fan 17 which recycles the steam. Steam lost through condensation or otherwise from the system is replaced via steam supply pipes 20 passing through the pipes 15 axially in the chambers 14. The fan 17 is driven by a motor 21, a pulley system 22 and a shaft 23.

A thermostat (not shown) is provided to control the heat exchanger and hence the vapour temperature.

The steam entering through jets 12 creates a rotating atmosphere of steam within the cylinder with an outer velocity of 25 to 50 m/s. This is higher than would be used with room temperature air due to the low density of superheated steam.

The steam is supplied to the jets at a pressure of 0.035 to 0.14 bar giving a jet velocity of about 100 to 200 m/s The process steam (at high or "factory" pressure) entering via pipe 20 is sufficient only to provide the heat to the tobacco and to make up losses.

Figure 1:
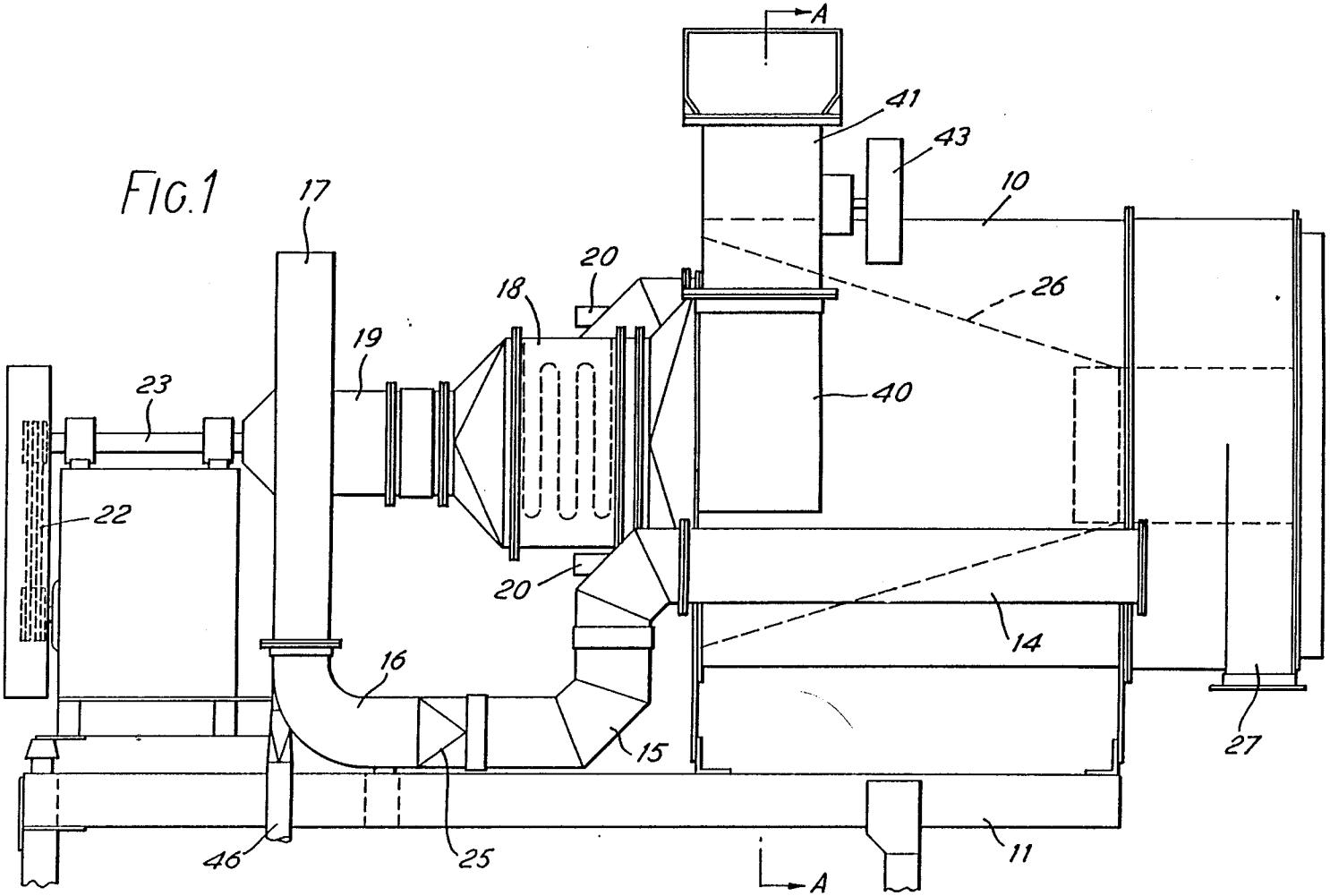
FIG. 1 is a side elevation of the apparatus.
Figure 2:
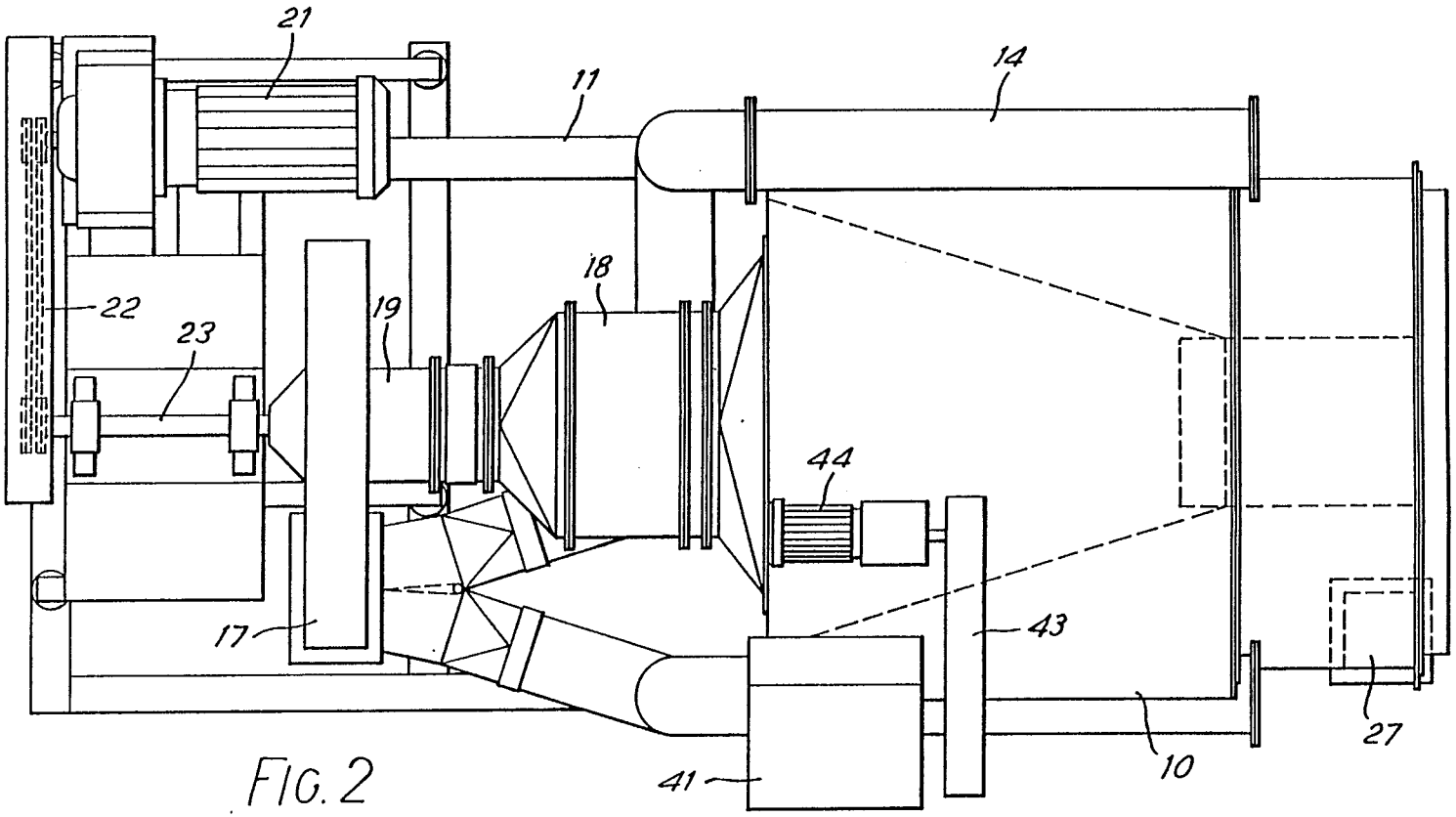
FIG. 2 is a plan view.
Figure 3:
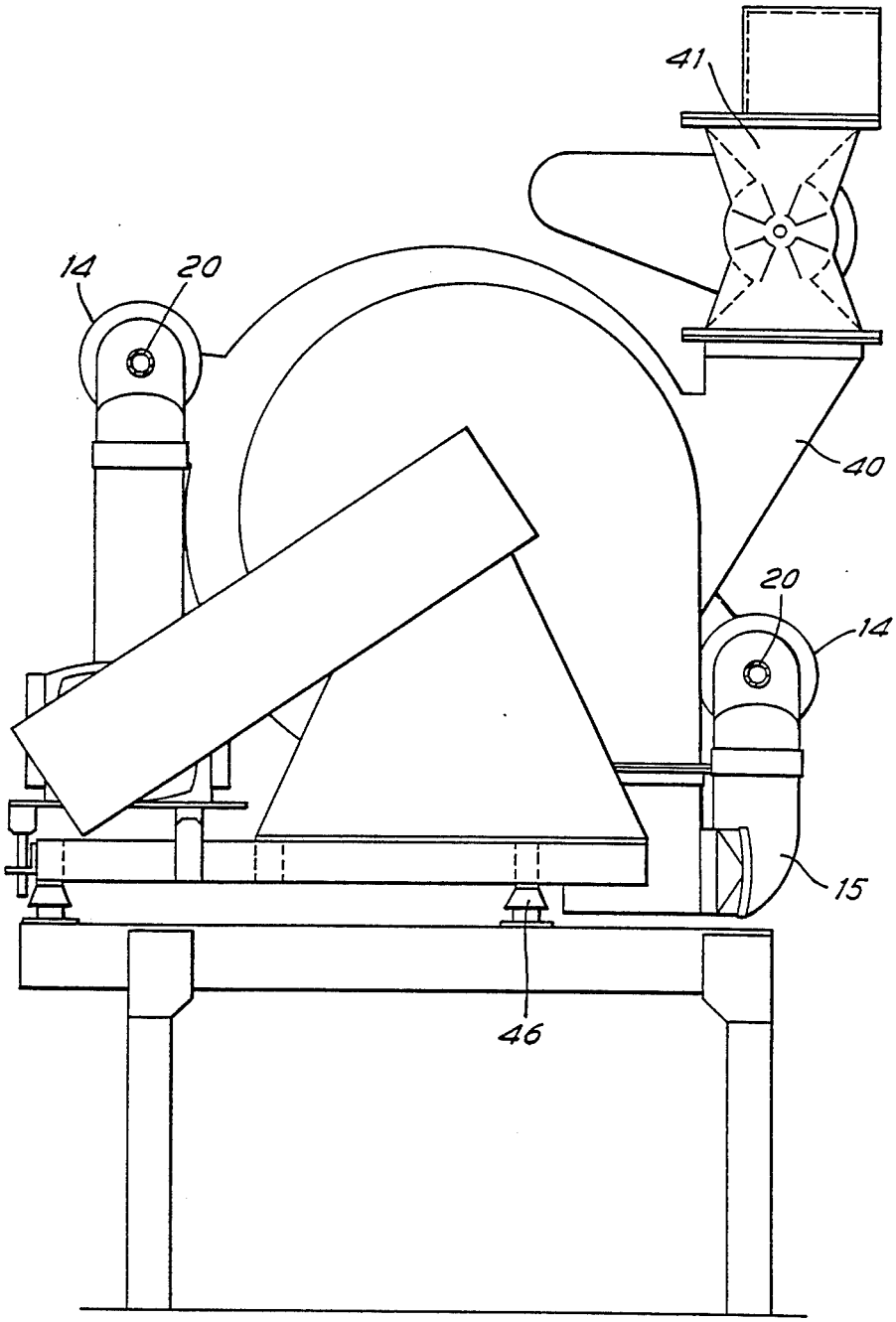
FIG. 3 is an end elevation of the tobacco in-feed end of the apparatus.
Figure 4:
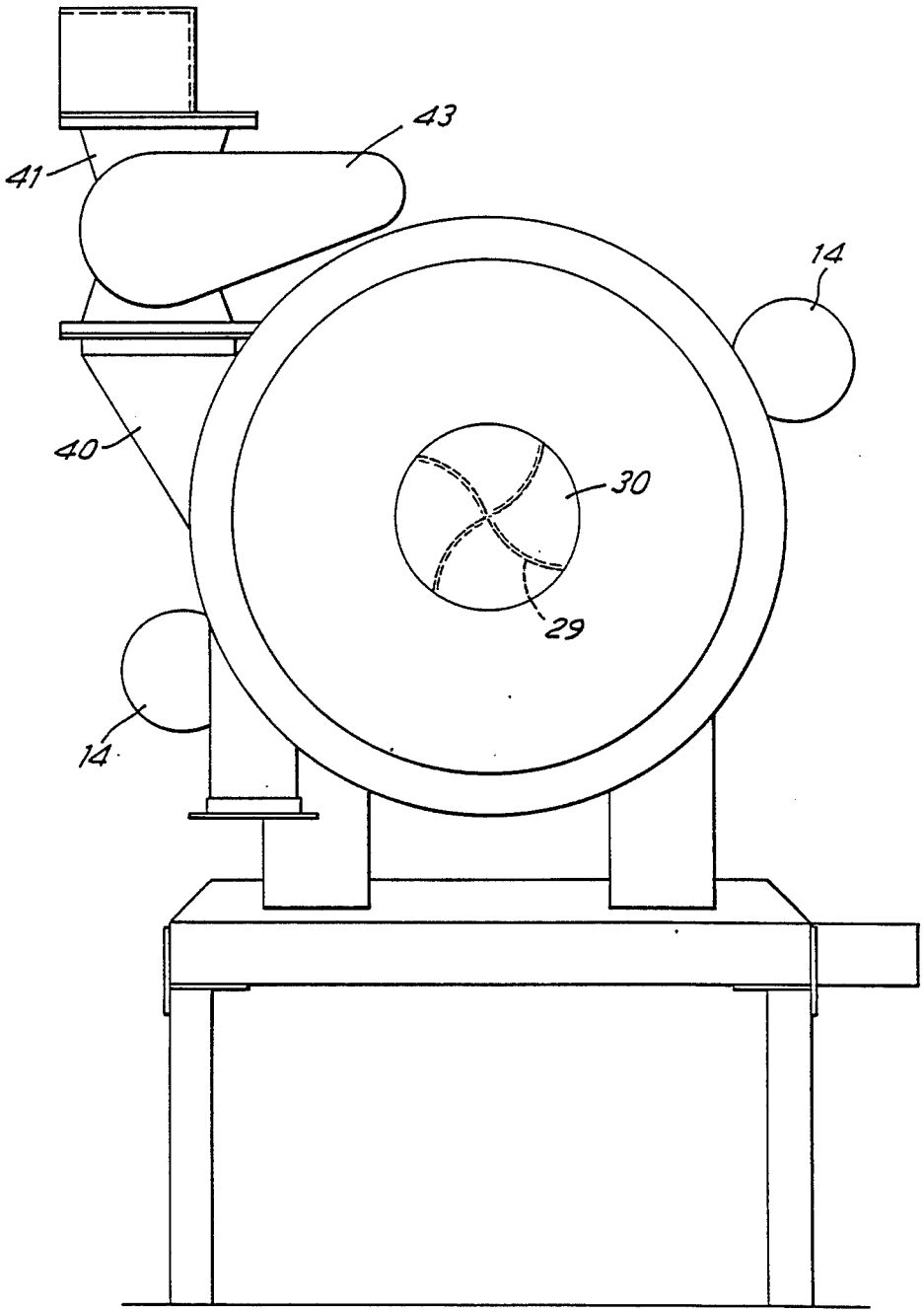
FIG. 4 is an end elevation of the tobacco outlet.

The cylinder 10 contains a conical separating partition 26 serving to receive the exhaust ending adjacent a tangential tobacco outlet 27 through which the processed tobacco is passed vertically downwards to a conveyor 28. Entry of separated steam into the conical partition is by way of an inlet comprising a series of scoops 24 arranged in star form in axial view (see FIGS. 4 & 5) having an end disc 30. The majority of the steam vapour is recycled, about 10 to 15% being condensed on the tobacco to heat it.

Tobacco is fed tangentially into the outer end of the process section via a chute 40 and inlet 41. To avoid the ingress of air into the system which lowers the operating temperature, the tobacco inlet 41 is sealed by rotating cell wheel 42 driven by a chain and sprocket system 43 and a motor 44.

A vapour bleed 46 from the fan 17 is adjustable to allow a small proportion (about 5% to 10%) of the circulating vapour to be discharged and may be set to balance the steam flow when tobacco feed commences.

The conditioner is shown with an horizontal axis, but in practice would be slightly inclined to clear condensate from the limpet heating tubes. With some rearrangement of the tobacco inlet chute the conditioner can be mounted with a vertical axis and downward tobacco discharge or at any angle between horizontal and vertical.

A door 46 is provided at the cylinder end and is arranged to swing open on hinges 47 to give access to the interior for cleaning and maintenance. The door may have a clear plastics or glass window 48.

In an alternative embodiment the tangential discharge is omitted and replaced by a conical outlet similar to a cyclone feeding direct into a drying cylinder. In this case the conditioner would be mounted from the drier with its axis at the same angle as the drying cylinder, typically 5 degrees.

In operation cut tobacco stems at normal cutting and rolling moistures of around 33% moisture, moisture content are fed into the chute 40 at a typical rate of 1500 kg/hr. A fast vibrating conveyor is used for the feed to give as steady a flow as possible. The tobacco meets the vapour circulating at 25 to 50 m/s and is accelerated. Due to the centrifugal force on the tobacco and the drag on the cylinder surface the tobacco only reaches less than half this velocity, i.e., about 15 to 30 m/s relative velocity. The centrifugal force is from 15 to 60 g.

The volume of vapour flow is around 140 cubic meters per minute and such that the vapour and tobacco circulates about four times in the process section, so the tobacco spends around 1 sec in the process section.

In making four circulations of the cylinder the tobacco is contacted eight times by the jet nozzles. The jets are at a much higher velocity than the general circulation and impinge on the tobacco with a high relative velocity, which create turbulence and dispersion of the tobacco, i.e., opening and high heat transfer rate.

The vapour is drawn off through the inlet at the apical end of the cone and the tobacco leaves via the outlet 27.

In an embodiment suitable for effecting drying in addition to expansion of the tobacco a heat exchanger 18 is provided preferably an electric superheater, for superheating the jet vapour to ensure suitable temperature difference between the steam vapour and tobacco.

The moisture in the tobacco is heated to boiling point so that the tobacco expands and the moisture removed until the tobacco becomes set in the expanded condition.

I claim:

1. A method for the expansion of tobacco in which the tobacco to be treated is fed into a substantially cylindrical stationary container and steam and/or humid air introduced into the container, comprising the steps of:

continuously feeding the tobacco into the container at or near one end and out at the other end;

introducing the steam substantially tangentially to the interior surface of the container by way of jet nozzles or slits to engage the entering tobacco causing the resulting turbulent mixture of steam and tobacco to travel along a helical path and to be maintained by centrifugal force against the interior surface of the container as the stream moves axially therein and to maintain the circulation and to provide a succession of repeated high relative velocity, highly turbulent and dispersive contacts between the heating medium and the tobacco;

separating the steam and/or humid air from the treated tobacco which is maintained by centrifugal force in close proximity to the interior surface of the cylinder, said steam and/or humid air being recycled and return to the jet nozzles or slits.

2. A method as claimed in claim 1, wherein the helical path increases in volume as the stream travels axially along the container.

3. A method as claimed in claim 2, wherein the helical path is defined between the interior surface of the container and a conical partition located coaxially within the cylindrical container.

4. A method as claimed in claim 3, wherein the stream at the end of its helical path is returned to the jet nozzles or slits via the interior of conical partition, a heat exchanger and a fan.

5. A method as claimed in claim 1 wherein the steam is superheated whereby the treated tobacco is first caused to expand as the steam gives up heat to the tobacco and is thereafter dried within the container to an appropriate moisture content prior to separation of the steam therefrom.

6. An apparatus for the expansion of tobacco comprising a substantially cylindrical stationary container, means for feeding tobacco into the container and means for introducing a heating medium in the form of steam and/or humid air into the container, wherein said means for introducing the steam and/or humid air has jet nozzles or slits arranged substantially longitudinally of the container axis serving to direct high pressure steam and/or humid air substantially tangentially to the interior surface of the container to engage the tobacco being fed into the container causing a turbulent mixture of steam, and/or humid air, and tobacco to travel along a helical path and to be maintained by centrifugal force in close proximity to the interior surface of the container as the stream moves axially therein and to maintain the circulation and to provide a succession of repeated high relative velocity, highly turbulent and dispersive contacts between the heating medium and the tobacco, and further comprising means for separating the steam and/or humid air from the treated tobacco and means for recycling the steam and/or humid air to the jet nozzles or slits.

7. An apparatus as claimed in claim 6, wherein a concical partition is located coaxially within the cylindrical container around which the stream of tobacco rotates.

8. An apparatus as claimed in claim 6, wherein the separating means has a series of scoops and an end disc forming an outlet from the container through which the separated heating medium enters the conical partition at the apical end thereof, together with a tangential outlet for the tobacco.

9. An apparatus as claimed in claim 7, wherein the means for recycling the heating medium has a duct communicating with the basal end of the conical portion, a fan, a duct and a nozzle or slit chamber.

10. An apparatus as claimed in claim 9, wherein a superheater is provided between the conical partition and the duct whereby steam is superheated to enable drying of the tobacco to follow the tobacco expansion.

11. An apparatus as claimed in claim 6, wherein the means for feeding the tobacco to the container have a chute arranged tangentially of the container, an inlet communicating with said chute, and a rotatable cell wheel serving to limit the ingress of air to the container.

12. An apparatus as claimed in claim 6, wherein the jet nozzles or slits are arranged at two diametcially opposed positions on the container.

13. An apparatus as claimed in claim 12, wherein the container is formed by two halves of a cylinder divided longitudinally and arranged with their axes slightly offset from each other, the jet nozzles or slits being arranged at the longitudinal junctions of the two half cylinders.

14. An apparatus as claimed in claim 9, wherein the means for recycling the heating medium further has a vapor bleed valve.

* * * * *